US005105953A

United States Patent [19]

Finnegan

[11] Patent Number: 5,105,953

[45] Date of Patent: Apr. 21, 1992

[54] DRAWER STORAGE RACK

[75] Inventor: Richard J. H. Finnegan, Ajax, Canada

[73] Assignee: Rev-A-Shelf Inc., Louisville, Ky.

[21] Appl. No.: 557,813

[22] Filed: Jul. 26, 1990

[51] Int. Cl.[5] ..... A47F 5/00

[52] U.S. Cl. ..... 211/183; 211/126; 211/128

[58] Field of Search ..... 211/126, 128, 194, 183; 108/93; 312/191, 183, 348.3, 330.1; 52/241

[56] References Cited

U.S. PATENT DOCUMENTS

| | | | |
|---|---|---|---|
| 3,648,849 | 3/1972 | Harris et al. | 211/126 |
| 4,074,810 | 2/1978 | Juergens et al. | 211/126 X |
| 4,353,470 | 10/1982 | Polhemus et al. | 211/126 |
| 4,619,095 | 10/1986 | Johnston | 52/241 X |

*Primary Examiner*—Blair M. Johnson

*Attorney, Agent, or Firm*—Kenneth M. Garrett

[57] ABSTRACT

A storage rack for use in cabinet drawers and the like comprises a first and second tray; the trays have a flange on each lateral side thereof. Support rails grip the flanges to support the second tray above the first. The flanges may be readily trimmed to tailor the rack to fit a wide range of drawers, with the rails preferably being wedged against the drawer sides to provide rigidity.

3 Claims, 2 Drawing Sheets

DRAWER STORAGE RACK

FIELD OF INVENTION

This invention relates to a rack for drawers to increase the storage capacity thereof in an organized manner.

BACKGROUND OF INVENTION

It is known to provide a draw organizer in the form of trays which may typically be shaped to provide various compartments for the storage of objects. It is further known to provide stacking trays for draws, including arrangements wherein the upper of the trays is mounted for sliding movement to expose the contents of the lower tray. The means for mounting the upper tray for sliding movement may comprise track elements integrally formed with the sides of the drawer per se. For retro fitting of stacking sliding trays it is known to provide track elements which must be secured to the drawer sides. However, this necessitates reasonably precise measurement and location of the track elements, which may be beyond the competence of may persons. It also limited the maximum drawer width to which trays of any particular width may be fitted.

The structure of drawers in recent years is becoming increasingly complex, with a trend away from the use of wood toward metal and plastic materials. Often the draw support means is integrally formed with the drawer sides, which does not facilitate or permit the fitting of track elements thereto for the support of sliding trays.

It is an object of my invention to provide a storage rack for drawers which is supported independently of the drawers.

SUMMARY OF INVENTION

In accordance with my invention, a storage rack comprises an upper tray and a lower tray, each tray being defined by axially extending wall structure including a base wall, a pair of laterally spaced apart side walls upstanding from the base wall and a horizontal flange extending laterally outwardly beyond each side wall. The rack further comprises a pair of support rails respectively locating outwardly along each side of the trays. Each support rail includes a lower track, an upper track, and means for supporting the upper track from the lower track in vertically spaced apart relationship. The lower track comprises first jaw means for receiving the flange of the lower tray therebetween. The upper track comprises second jaw means for receiving the flange of the upper tray therebetween in sliding therealong.

Preferably the lower track is received in the first jaw in strong interfering relationship, so as to anchor the support rail to the lower tray. Other means for accomplishing this end may be used including the use of other coacting mechanical means or of an adhesive substance, for example. It is generally advantageous that the flanges be laterally adjustable within the jaw means to permit the trays to be custom fitted to drawers of different widths. To this end the flanges are generally formed with a lateral width equal to about 10% of the lateral width of the tray bottom. Thus a tray having a nominal width of about eighteen inches will preferably be manufactured with flanges of approximately two inches on each lateral side thereof, such flanges may be trimmed in width to be approximately equal to the width of the track, normally one half inch, whereby a rack based on trays of the foregoing dimensions may be fitted to draws having a minimum width of approximately nineteen inches, with no limitation in the maximum drawer width with which rack may used.

The location of the flanges on the lateral side wall is not critical, although from a manufacturing standpoint it is preferred that the flanges connect along the upper edge of the lateral sides of the tray. This is also preferred from a functional standpoint, to prevent the formation of a trough between the side of the tray and the drawer sides within which detritus may collect.

Suitably the means for supporting the upper track from the lower track comprises a continuous web, and conveniently the rail is formed as a plastic or metal extrusion having a constant cross-section therealong. Generally it is preferred that the rack be tailored so that the web portion of the rails will be in moderately tight frictional contact with the lateral side of the drawer, so tending to rigidify the rack and permit it to carry heavier loads than if it were free-standing within a drawer, for example. To this end, the rails are formed so that the web is slightly upwardly outwardly canted when the rack is free standing, whereby the web will tend to wedge against the drawer sides.

These foregoing objects and aspects of the invention, together with other objects, aspects and advantages thereof will be more apparent from the following description of a preferred embodiment thereof, taken in conjunction with the following drawings.

DESCRIPTION OF THE PREFERRED EMBODIMENT

Figure 1:
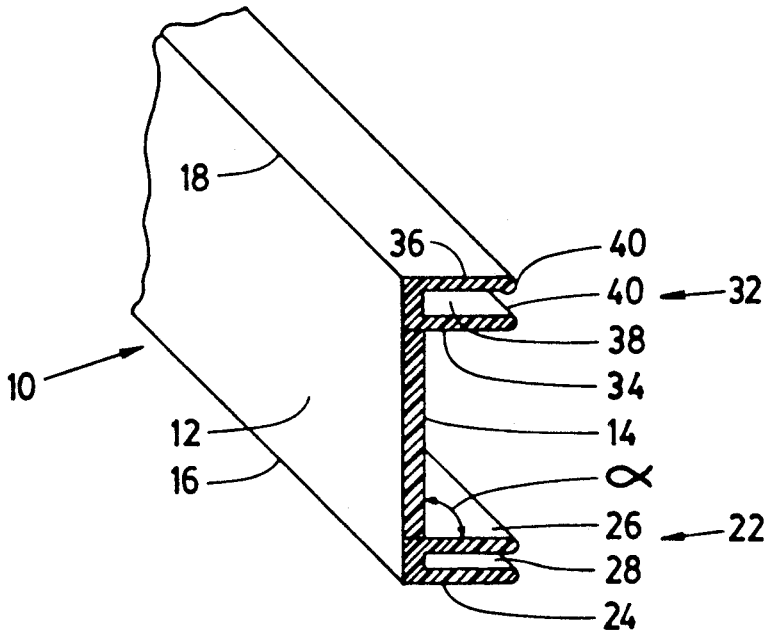
FIG. 1 shows in perspective view a support rail in accordance with the invention for use in assembling a drawer storage rack.

In the drawings, like parts are identified throughout by like numerals. Referring to the drawings in detail, a support rail in accordance with the invention is identified in FIGS. 1 and 2 by the numeral 10. Rail 10 comprises an axially extending planar web 12 having a major surface 14 bounded by a lower edge 16 and an upper edge 18. Extending outwardly from major surface 14 adjacent the lower edge 16 thereof is a first pair of axially aligned jaws 22 comprising opposed jaw members 24, 26 spaced apart to form a slot 28 between. Rail 10 further comprises a second pair of axially aligned jaws 32 extending outwardly from major surfaces 14 adjacent the upper edge 18 thereof. Jaws 32 comprise opposed jaw members 34, 36 spaced apart to form a slot 38 therebetween. Jaw members 34, 36 are provided with lips 40 threrealong which form a slight constriction to the entrance to slot 38, but otherwise slots 38 and 28 have a constant height, i.e. the vertical dimension as seen in FIG. 1 across the width thereof, the height of slot 38 being somewhat greater than that of slot 28. The angle and included between lower jaws 22 and upper jaws 32 is marginally greater than 90°, about 92° being preferred. Otherwise expressed, web 12 is upwardly outwardly canted from jaws 22, the purpose thereof being set forth subsequently herein. Expediently rail 10 is formed as a resilient plastic extrusion.

Figure 2:
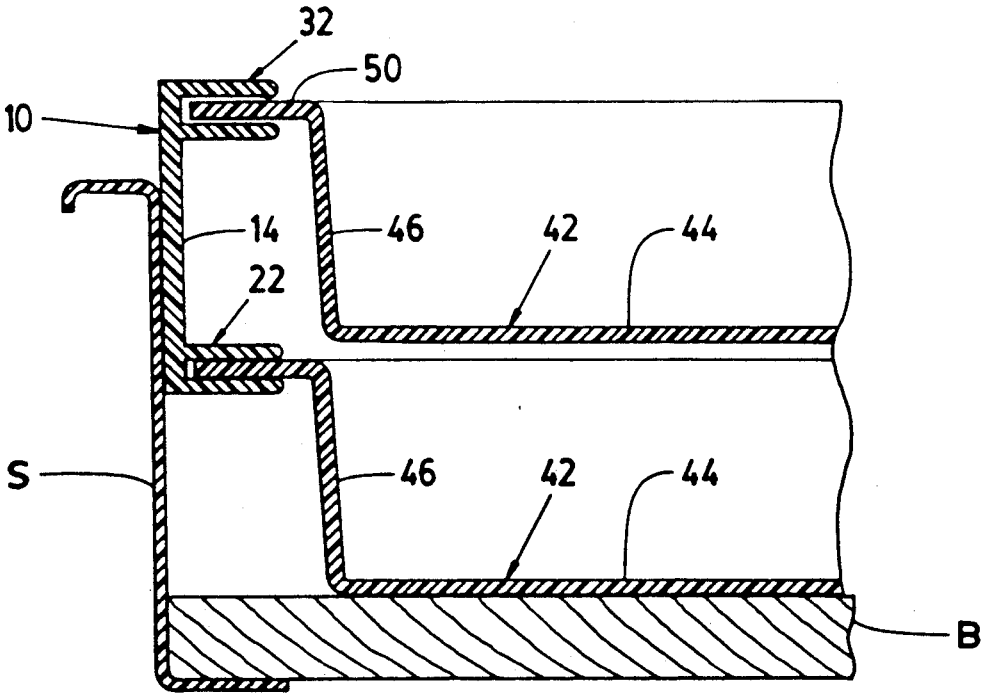
FIG. 2 shows in transverse section one side of a drawer storage rack assembled using the support rail of FIG. 1, as the rack would be normally positioned within a drawer, the other side being a mirror image of that shown.
Figure 3:
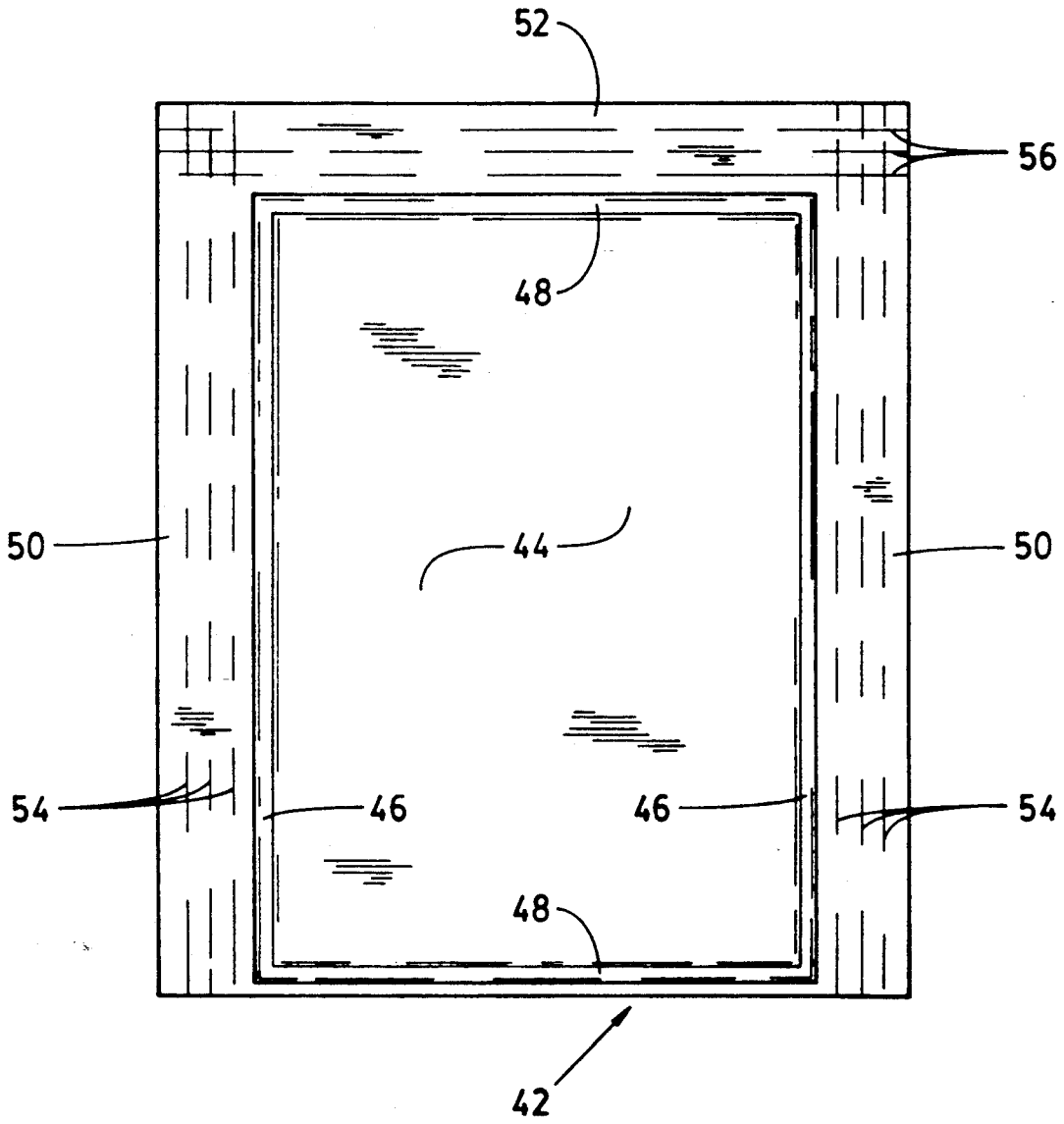
FIG. 3 shows in plan form a tray suitable for use in assembling the drawer storage rack of FIG. 2.

Referring now to FIGS. 2 and 3 a tray suited for use with rail 10 is identified generally by the normal 42. Tray 42 is defined by wall structure including a base wall 44, and upstanding therefrom a pair of transversely spaced apart side walls 46 and a pair of axially spaced apart end walls 48. A relatively wide flange 50 extends outwardly from the upper edge of each side wall 46, and a similar flange 52 extends rearwardly from one end wall 40. Flanges 50, are marked with a series of axially aligned lines 54 thereon; flange 52 is similarly marked with transversely aligned line 56 thereon.

The dimensions of rail 10 and tray 42 are not critical, but they will be somewhat inter-related. Thus the thickness of flanges 50 will be such that a flange will be preferably gripped in a strong interfering relationship when entered in slot 28; but will easily slidable in the axial direction when entered into slot 38. The width of flanges 50 may vary widely, but typically where a tray 42 is intended to be tailored to fit a range of drawers of somewhat different widths, a flange 50 will have a lateral width as manufactured of about 10 to 12% of the lateral width of the tray base wall 44, to premit trimming of the flanges to reduce their width. A series of axially aligned score lines 60 being marked on flanges 50 to facilitate trimming. Rear flange 52 is similarly provided with a plurality of score lines 62 parallel to the transverse direction to facilitate trimming of the axial length of the tray 42.

With specific reference to FIG. 2, flanges 50 are preferably adjusted in width whereby when fully inserted into slots 28 to form a rack, the outward facing major surface 64 of web 12 will be located in tight abutment with the sides S of a drawer when the lower of the trays 42 is seated on the drawer bottom B. The outward canting of web 12 facilitating a wedging action.

It will be apparent that many changes may be made to the illustrative embodiment, while falling within the scope of the invention and it is intended that all such changes be covered by the claims appended hereto.

I claim:

1. A rail for use with drawer trays comprising:

an axially extending web, having a major surface bounded in part by an upper edge;

a first pair of axially aligned jaws extending outwardly from said major surface adjacent to said upper edge;

a second pair of axially aligned jaws extending outwardly from said major surface beneath said first pair of jaws;

said jaws and said web being generally coextensive;

the jaws of said first pair of jaws having a marginally greater spacing therebetween than the jaws of said second pair of jaws in at medial longitudinal portions thereof; the included angle between said second pair of jaws and said web being marginally greater than 90°.

2. A rail as defined in claim 1, wherein said first pair of jaws is provided with lips adjacent the entrance thereto.

3. A rail as defined in claim 1, in the form of a plastic extrusion having a constant cross section therealong.

* * * * *

UNITED STATES PATENT AND TRADEMARK OFFICE

CERTIFICATE OF CORRECTION

PATENT NO. : 5,105,953

DATED : April 21, 1992

INVENTOR(S) : Richard J.H. Finnegan

It is certified that error appears in the above-indentified patent and that said Letters Patent is hereby corrected as shown below:

Column 1, line 52, after "sliding" insert --relationship--;

Column 4, line 25, after "at" insert --least--

Signed and Sealed this

Twelfth Day of October, 1993

*Attest:*

Bruce Lehman

BRUCE LEHMAN

*Attesting Officer*

*Commissioner of Patents and Trademarks*